US007578797B2

(12) United States Patent
Hazard

(10) Patent No.: US 7,578,797 B2
(45) Date of Patent: Aug. 25, 2009

(54) SYSTEM FOR PROVIDING LUMBAR MOTION AND SUPPORT

(76) Inventor: Rowland G. Hazard, 38 Harrington Ter., Burlington, VT (US) 05401

( * ) Notice: Subject to any disclaimer, the term of this patent is extended or adjusted under 35 U.S.C. 154(b) by 0 days.

(21) Appl. No.: 11/314,650

(22) Filed: Dec. 21, 2005

(65) Prior Publication Data

US 2006/0094993 A1 May 4, 2006

Related U.S. Application Data

(63) Continuation of application No. 09/957,205, filed on Sep. 20, 2001, now abandoned.

(51) Int. Cl.

| | |
|---|---|
| ***A47C 1/00*** | (2006.01) |
| ***A47C 3/00*** | (2006.01) |
| ***A47C 7/36*** | (2006.01) |
| ***A47C 7/40*** | (2006.01) |

(52) U.S. Cl. ..... 601/103; 601/24; 601/26; 297/273; 297/278; 297/340; 297/383; 482/92; 482/131

(58) Field of Classification Search ..... 601/24, 601/26, 49, 86, 90, 91, 92, 98, 101, 103, 601/27, 28, 34, 35; 297/330, 452.19, 452.21, 297/452.3, 452.31, 337, 353, 284.7; 482/95, 482/96, 131, 132, 142

See application file for complete search history.

(56) References Cited

U.S. PATENT DOCUMENTS

| | | | | | |
|---|---|---|---|---|---|
| 2,427,053 | A | * | 9/1947 | Hampton | 601/98 |
| 3,851,916 | A | * | 12/1974 | Quartullo | 297/188.21 |
| 4,086,676 | A | * | 5/1978 | Arruza | 114/363 |
| 4,819,987 | A | * | 4/1989 | Stringer | 297/423.35 |
| 5,171,063 | A | * | 12/1992 | Stidd | 297/344.1 |
| 5,460,427 | A | * | 10/1995 | Serber | 297/216.19 |
| 5,637,076 | A | * | 6/1997 | Hazard et al. | 601/5 |
| 5,678,886 | A | * | 10/1997 | Infanti | 297/217.3 |
| 5,727,848 | A | * | 3/1998 | Gazard | 297/423.36 |
| 5,782,536 | A | * | 7/1998 | Heidmann et al. | 297/440.15 |
| 5,857,739 | A | * | 1/1999 | Smith | 297/88 |
| 5,871,258 | A | * | 2/1999 | Battey et al. | 297/317 |
| 5,975,634 | A | * | 11/1999 | Knoblock et al. | 297/300.4 |
| 6,027,168 | A | * | 2/2000 | Crossman et al. | 297/337 |

(Continued)

FOREIGN PATENT DOCUMENTS

| | | | |
|---|---|---|---|
| DE | 2501674 | A * | 7/1975 |

(Continued)

*Primary Examiner*—Justine R Yu
*Assistant Examiner*—Clinton Ostrup
(74) *Attorney, Agent, or Firm*—Choate Hall & Stewart, LLP

(57) ABSTRACT

A seating system for providing spinal motion and support. The system comprising a substantially static structure adjacent to the back of a user, a moving apparatus supplying a motive force, wherein the moving apparatus is adjacent to the buttocks and thighs of the user and is powered by the lower extremities of the user, a force applying structure disposed between the static structure and the back of the user, the force applying apparatus including a back engaging surface for increasing and decreasing a force applied to the back of the user in response to the supplied motive force, and a structure for locking the moving apparatus in place. Various embodiments of moving apparatus, force applying structure, and locking and/or motion limiting structure are presented.

6 Claims, 13 Drawing Sheets

U.S. PATENT DOCUMENTS 6,135,556 A * 10/2000 Chu et al. ..... 297/337
6,145,929 A * 11/2000 Gollahon ..... 297/344.1
6,196,631 B1 * 3/2001 Larson ..... 297/423.26
6,554,203 B2 * 4/2003 Hess et al. ..... 239/69
6,572,190 B2 * 6/2003 Koepke et al. ..... 297/284.4
6,824,219 B2 * 11/2004 Ruckstadter ..... 297/423.27
2002/0036420 A1 * 3/2002 Footitt ..... 297/284.4

FOREIGN PATENT DOCUMENTS

WO WO 9522307 A1 * 8/1995

* cited by examiner

SYSTEM FOR PROVIDING LUMBAR MOTION AND SUPPORT

This application is a continuation of U.S. patent application Ser. No. 09/957,205 filed Sep. 20, 2001, now abandoned, and entitled "System for Providing Lumbar Motion and Support," the contents of which are incorporated herein by reference.

FIELD OF THE INVENTION

The present invention relates generally to a system and method for providing motion and support to the lumbar region of the spine. In particular, the invention provides a moving seat apparatus that increases and decreases pressure applied to the lumbar region of the spine.

BACKGROUND OF THE INVENTION

A user places an enormous amount of stress on the spine when situated in a seated position. Prolonged sitting in the same position can cause fatigue, stiffness and severe back pain due to stress and strain on the ligaments and intervertebral disks of the spine. Supporting the lumbar curve of the spine reduces the load on the low back muscles. Lumbar supports, such as cushions, bladders and mechanical devices, have been widely adopted and integrated into many seating systems available today.

Gradually changing the position of the lumbar spine allows the various spinal muscles and ligaments to share the load of the upper body. Further, spinal movement can create changing pressure patterns within the intervertebral discs, facilitating circulation of fluid-borne nutrients and metabolites in and out of the discs. Continuous movement of the spine is known to increase flexibility and hydration of the disks, with the potential to prevent degeneration while decreasing stiffness and pain. Spinal motion is ideally accomplished while the head is maintained in a relatively stable position that allows steady visual contact for task performance. Intermittent soft-tissue compression may further comfort the user through a massage effect. The applicant has been issued U.S. Pat. No. 4,981,131 (hereinafter "the '131 patent") related to continuous passive motion (CPM), the teachings of which are herein incorporated by reference. The '131 patent discloses an apparatus for cycling the lumbar region of the spine through a substantial range of lordosis (forward spinal curvature) for the purpose of relieving low back pain. In that patent, an inflatable bladder in contact with the back is pressurized and depressurized to affect the substantial range of lordosis.

There was no provision, however, in the '131 patent for the user to apply, adjust, and control the force applied to the back without the input of electricity into the apparatus of the invention. The '131 patent disclosed DC voltage input to a processor board which controlled and processed information from the pump, valve, and pressure transducer. Through extensive experience with CPM technology, the inventor has discovered that individual users require or prefer varying amounts of maximum and minimum pressures, rates of applied force, and lengths of applied force. It has further been found that movement of the spine may be increased if the movement of the lower extremities increases. Need, therefore, exists to allow a user to freely control the force rate and length of time, and amount of pressure applied to the spine and soft tissues. Further, a need exits to allow the user such control over spinal motion without the necessity of electric power and while encouraging lower extremity movement.

It is one object of the invention to provide a means and method of reducing fatigue, stiffness and severe back pain due to stress and strain on the ligaments and intervertebral disks of the spine caused in the seated position. More particularly, it is an object of the invention to support the lumbar curve of the spine and apply motion to the lumbar region of the spine and intermittent compression of the soft tissues. Further, it is an object of the invention to maintain a relatively stable position of the eyes and head to allow for task performance, but encourage lower extremity movement, while applying motion to the lumbar region of the spine.

SUMMARY OF THE INVENTION

The present invention addresses the needs described above and alleviates many of the aforementioned problems. The invention disclosed herein is directed to a seating system for providing support and motion to the lumbar region of the spine. The present invention allows a user to generate and control the pressure applied and support given to the lumbar region of the spine while in a seated position.

In one aspect, this invention provides a seating system comprising a substantially static structure adjacent to the back of a user, a moving seat apparatus supplying a motive force, a force applying means disposed between the static structure and the back of the user, and a means for locking the moving apparatus in place. The moving apparatus further comprises a movable seat pan adjacent to the buttocks and thighs of the user, the motion of which is powered by the lower extremities of the user. The force applying means includes a back engaging surface for increasing and decreasing force applied to the back of the user in response to the supplied motive force. The system may optionally further include a substantially static foot rest structure, where the foot rest is situated beneath, and may be adjusted to the length of, the lower extremities of the user. The substantially static foot rest structure may be removed and stored underneath the seat.

In another embodiment, the moving apparatus further comprises a track assembly, a portion of which is connected to the seat pan and a portion of which is connected to a bottom support of the seating system, wherein the seat pan rolls along the track assembly, thereby increasing or decreasing the motive force supplied to the force applying means. Alternatively, the track assembly may comprise a glider assembly, allowing the seat pan to glide along the glider assembly rather than roll.

The seat pan is preferably predisposed to move toward or away from the back rest. For example, the seat pan may be preloaded by means of a spring mechanism to increase resistance to movement toward or away from the back rest. Additionally, the seat pan may be adjusted to tilt forward or backward.

In another embodiment, the moving apparatus further comprises a substantially static suspension assembly and a swing assembly suspended from the suspension assembly. The swing assembly supports and allows the movement of the seat pan, which in turn increases or decreases the motive force supplied to the force applying means.

It may be desirable to tailor the height and location of the back engaging surface with respect to the back of the user. To this end, the system may include a means for adjusting the height of the back engaging surface. It may further be desirable to tailor the correlation between the movement of the seat pan and the movement of the force applying means. In another embodiment, therefore, the system further comprises a means for adjusting the correlation between the seat pan movement and the force applying means movement.

In related embodiments, the force applying means further comprises a pump with an inflating and deflating bladder, a rack and pinion arrangement, a mechanical cam arrangement, or a gear and cable arrangement for translating the force supplied by the moving apparatus into the force delivered by the force applying means to the back of the user.

In yet another embodiment, the moving apparatus may be electronically powered rather than powered by the user's lower extremities. In this embodiment, the motion of the seat pan is still responsible for supplying the motive force to the force applying means for translation to a back engaging force.

BRIEF DESCRIPTION OF THE DRAWINGS

The invention is described with reference to the several figures of the drawing which are presented for the purpose of illustration only, and in which.

DETAILED DESCRIPTION

Preferred embodiments of the invention will now be described with reference to the accompanying drawings. A seating system according to the present invention comprises a substantially static structure adjacent to the back of a user, a moving apparatus adjacent to the buttocks and thighs of the user supplying a motive force, a force applying means disposed between the static structure and the back of the user, the force applying means including a back engaging surface for increasing and decreasing a force applied to the back of the user in response to the supplied motive force, and a means for locking the moving apparatus in place. Numerous embodiments employing different support structures for the moving apparatus and/or means for translating the motive force supplied by the moving apparatus into a force applied to the back of the user are described below for conveying the concepts of the invention and are not intended to be limiting in any manner.

Figure 1:
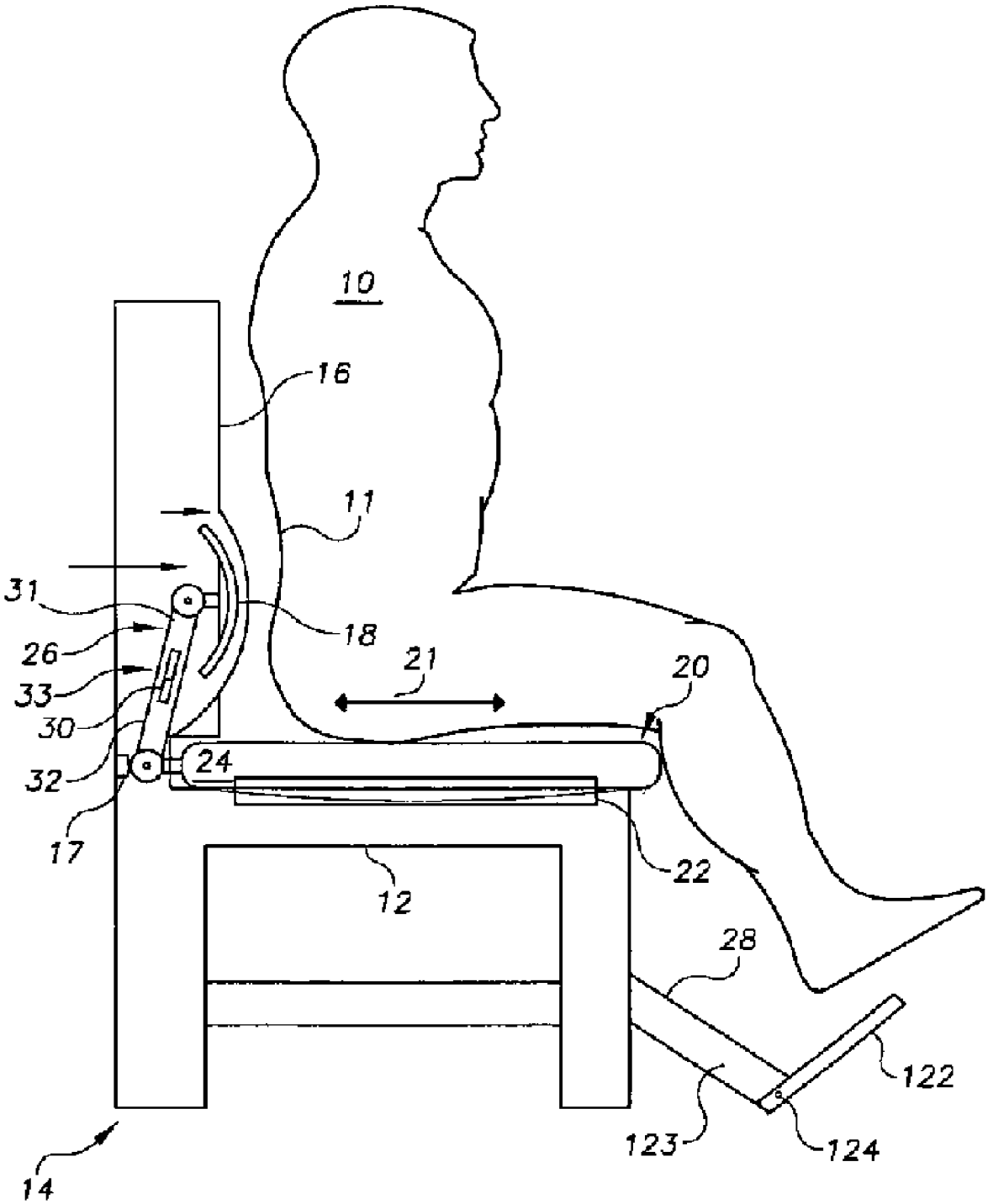
FIG. 1 is a schematic diagram illustrating a seating system for providing motion and support to the lumbar region of the spine in accordance with the invention.

Referring now to the figures of the drawing, FIG. 1 provides a side view of a user 10 seated in such a seating system 14, having a bottom support 12 and a substantially static structure (hereinafter called a back rest) 16 adjacent to the back of the user 10. The seating system may be an office chair, for example, or any other seat in which a user may spend extended periods. A force applying means 26 including a back engaging surface 18 is disposed between the user 10 and the back rest 16. A moving seat apparatus 20 supplying a motive force to the force applying means 26 is disposed between the user 10 and the bottom support 12. In the embodiment depicted in FIG. 1, the moving seat apparatus 20 is comprised of a track assembly 22 slidably connected to a seat pan 24 constrained for motion in two opposite directions indicated by arrow 21. The seating system 14 may further include a substantially static foot rest 28 that is adjustable to lower extremity length, and is also removable. As will become clear below, the seating system 14 moves the lumbar region 11 of the user 10 so as to cycle the lower back or lumbar region 11 through a substantial range of lordosis or simply to create a soft tissue massaging effect by changing the pressure on the lower back from time to time.

An important aspect of this invention is the ability of the user to control the amount and rate of force applied to the lumbar region, without the use of electricity. According to this embodiment of seating system 14, the user places his or her feet flat against the foot rest structure 28 and pushes against it, propelling the seat pan 24 backward towards the back rest 16. The moving apparatus 20 thereby supplies a motive force to the force applying means 26, which adjustably translates the motive force into a pressure applied to the lumbar region of the user's spine. The use and movement of the lower extremities further helps to shift ischial pressure points at the base of the spine.

FIG. 1 further illustrates a seating system embodiment in which the force applying means 26 is comprised of a lever system in communication with the moving apparatus 20. The backward movement (with respect to a seated user) of the seat pan 24 forces the low end 32 of a lever arm 33 backward. As the low end 32 of the lever arm 33 moves backward, the high end 31 of the lever arm 33 is forced forward as the entire lever arm 33 pivots about an adjustable fulcrum 30. As the high end 31 of the lever arm 33 moves forward, the back engaging surface 18 also moves forward. The forward movement of the back engaging surface 18 applies pressure to the lumbar region 11 of the spine, thereby generating lordotic spinal motion and soft tissue compression. Reversing the process, the pressure delivered by the back engaging surface 18 may be decreased by moving the moving seat pan 24 in a forward direction, pulling the low end 32 of the lever arm 33 forward, causing the high end 31 of the lever arm 33 to move in a direction away from the lumbar region 11. The correlation between the extent of seat pan 24 movement and the force applying means 26 movement and resulting pressure delivered to the lumbar region 11 may be adjusted using the adjustable fulcrum 30.

In another embodiment (not depicted), a double fulcrum may replace the adjustable fulcrum 30 in the force applying means. This would result in reversing the relationship between the direction of motion of seat pan 24 and motion of the back engaging surface 18. That is, in a double fulcrum configuration, a forward motion of the seat pan 24 will generate forward movement in the lumbar support's back engaging surface 18, and a corresponding increase in resulting pressure.

The motion of the seat pan 24 is horizontal and perpendicular to the back rest 16. In another embodiment of the invention, the moving apparatus is preferably predisposed to move away from the back rest 16. For example, the seat pan 24 may be preloaded by means of a spring mechanism 17 to create resistance to movement away from the back rest 16.

Figure 2A:
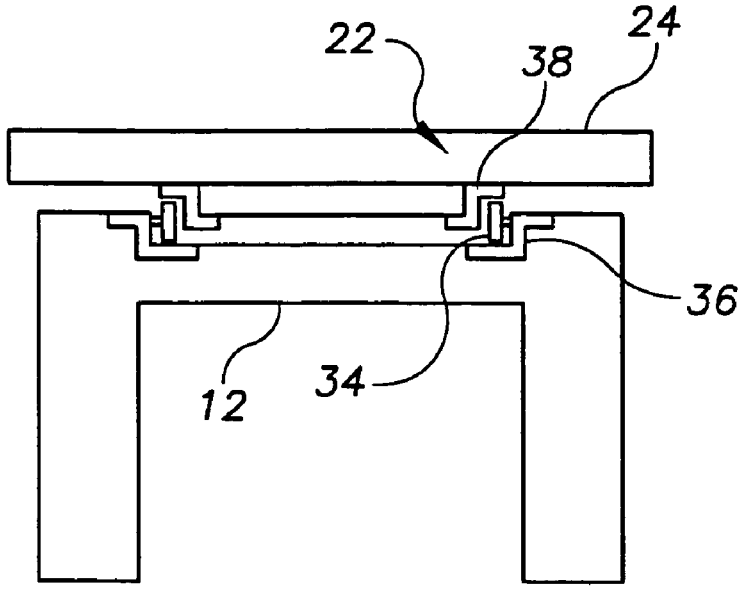
FIG. 2*a* is a schematic diagram illustrating a front view an embodiment of a rolling track assembly.

FIG. 2*a* illustrates a front view of the track assembly 22 upon which the seat pan 24 rolls forward and backward with respect to the back rest 16. The track assembly 22 is further comprised of one or more roller bearings (or guide wheels) 34 in communication with one or more roller tracks 36 and one or more guide tracks 38. The one or more roller tracks 36 either are components of, or connected to, the bottom support 12. The one or more guide tracks 38 either are components of, or connected to, the seat pan 24. The components of the track assembly 22 cooperate to allow the seat pan 24 to roll in a direction perpendicular to the back rest 16 preferably in an adjustable range of motion between 0.5 and 5.0 inches. Means for partially or completely restricting (locking) the position of the seat pan 24 are described below.

Figure 2B:
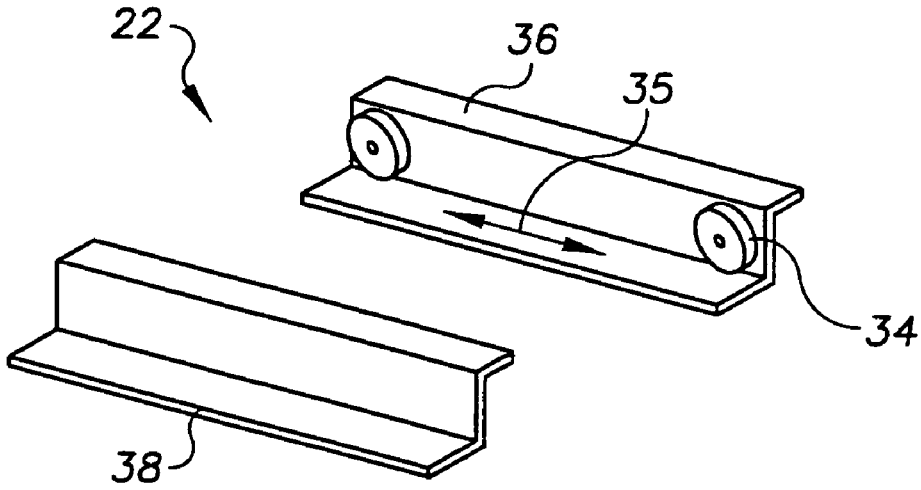
FIG. 2*b* is a schematic diagram illustrating a track assembly.

FIG. 2*b* illustrates the components of a track assembly 22 without depicting the surrounding moving apparatus 20 or bottom support 12. It more clearly shows how a roller track 36 receives one or more roller bearings (or guide wheels) 34 and one or more guide tracks 38. The direction of motion supported is linear along the tracks and indicated by arrow 35. Each component of the track assembly 22 should be composed of a material with a strength sufficient to support the weight of a user seated in the chair, and should be manufactured and arranged in a manner to minimize friction between the other components.

Figure 2C:
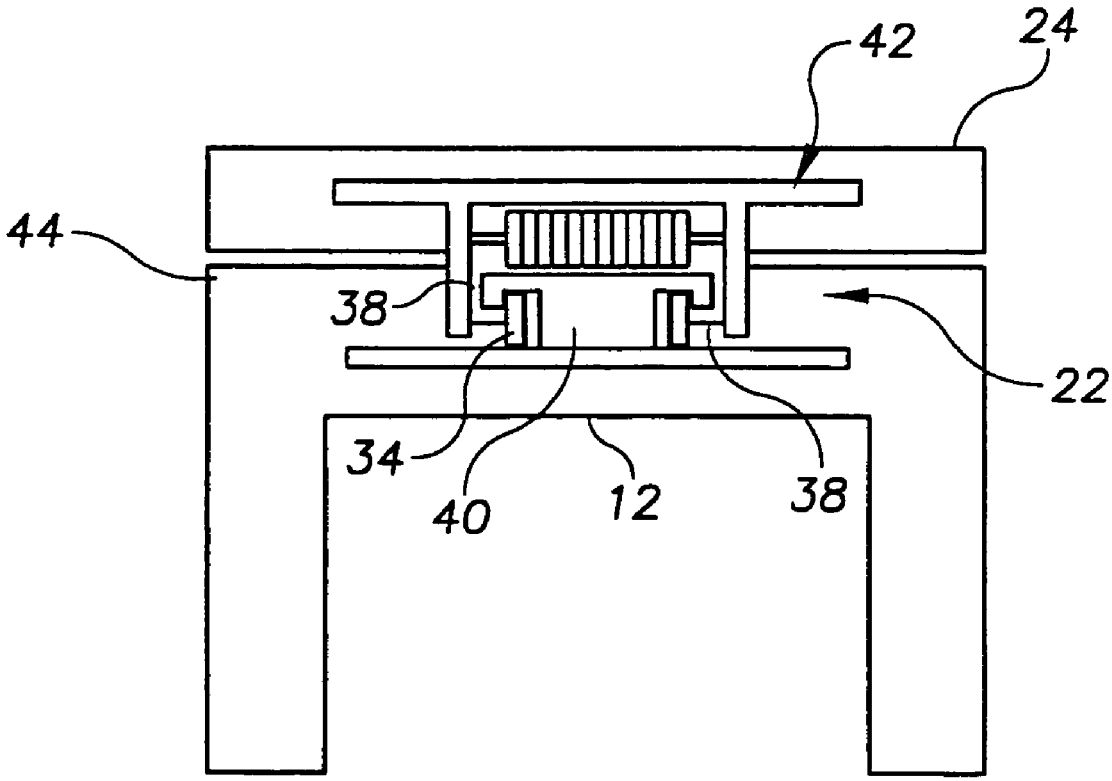
FIG. 2*c* is a schematic diagram illustrating a front view of a rolling track assembly.

FIG. 2*c* illustrates a front view of an alternative embodiment of the track assembly 22. In this embodiment, a plate structure 40 is embedded within and along the length of the bottom support 12. The plate structure 40 may, for example, be a metal, "T" shaped plate structure with at least one but preferably two guide tracks 38 running parallel along the side of the plate structure. A mounting system 42 is embedded within the movable seat pan 24, and is supported by one or more roller bearings (or guide wheels) 34 and one or more wide top rollers 44. The entire mounting system 42 supports and moves with the seat pan 24 forward and backward along the plate structure 40 in a direction perpendicular to the back rest 16. The wide top roller 44 and roller bearings 34 support and constrain the motion of the seat pan 24 and embedded mounting system 42 over and along the plate structure 40. As in other embodiments, one may constrain the range of allowable seat pan 24 motion or lock the seat pan 24 in one position so that the seating system applies a constant desired force to the lumbar region 11 of the spine. This is described below.

Figure 2D:
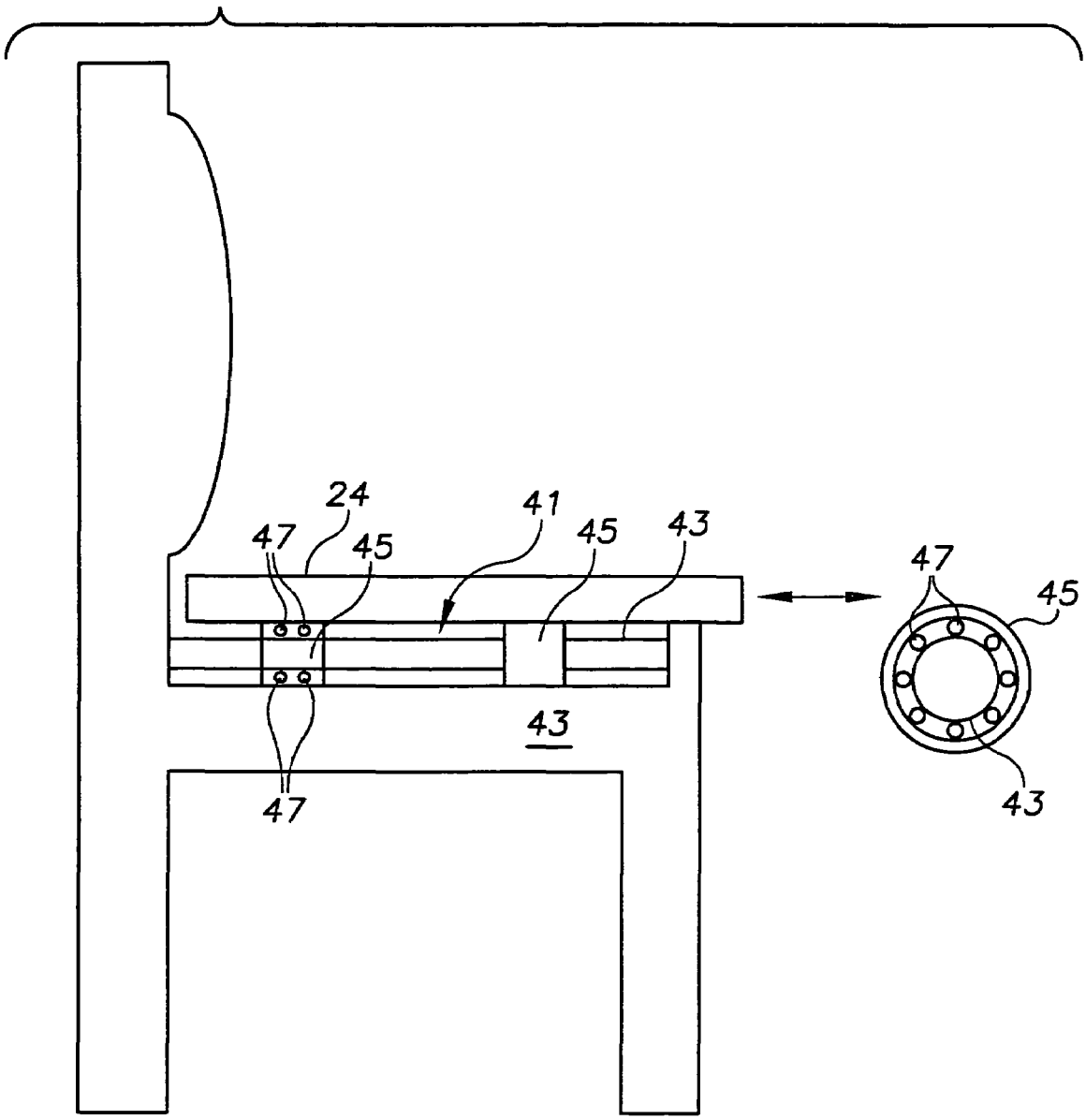
FIG. 2*d* is a schematic diagram illustrating a side view of a seating system employing a sliding mechanism for seat pan motion.

FIG. 2*d* illustrates a slide mechanism 41 upon which the seat pan 24 may move back and forth in yet another embodiment. The slide mechanism 41 is comprised of one, but preferably two tubes 43 which are affixed to the bottom support 12 and oriented in a horizontal, front-to-back position. Affixed to the seat pan 24 are at least one, but preferably a plurality of holders 45 which slide forward and backward along the tubes 43 in a low friction manner enabled by the presence of a plurality of ball bearings 47 interspersed between each of the tubes 43 and each of the holders 45.

Figure 3:
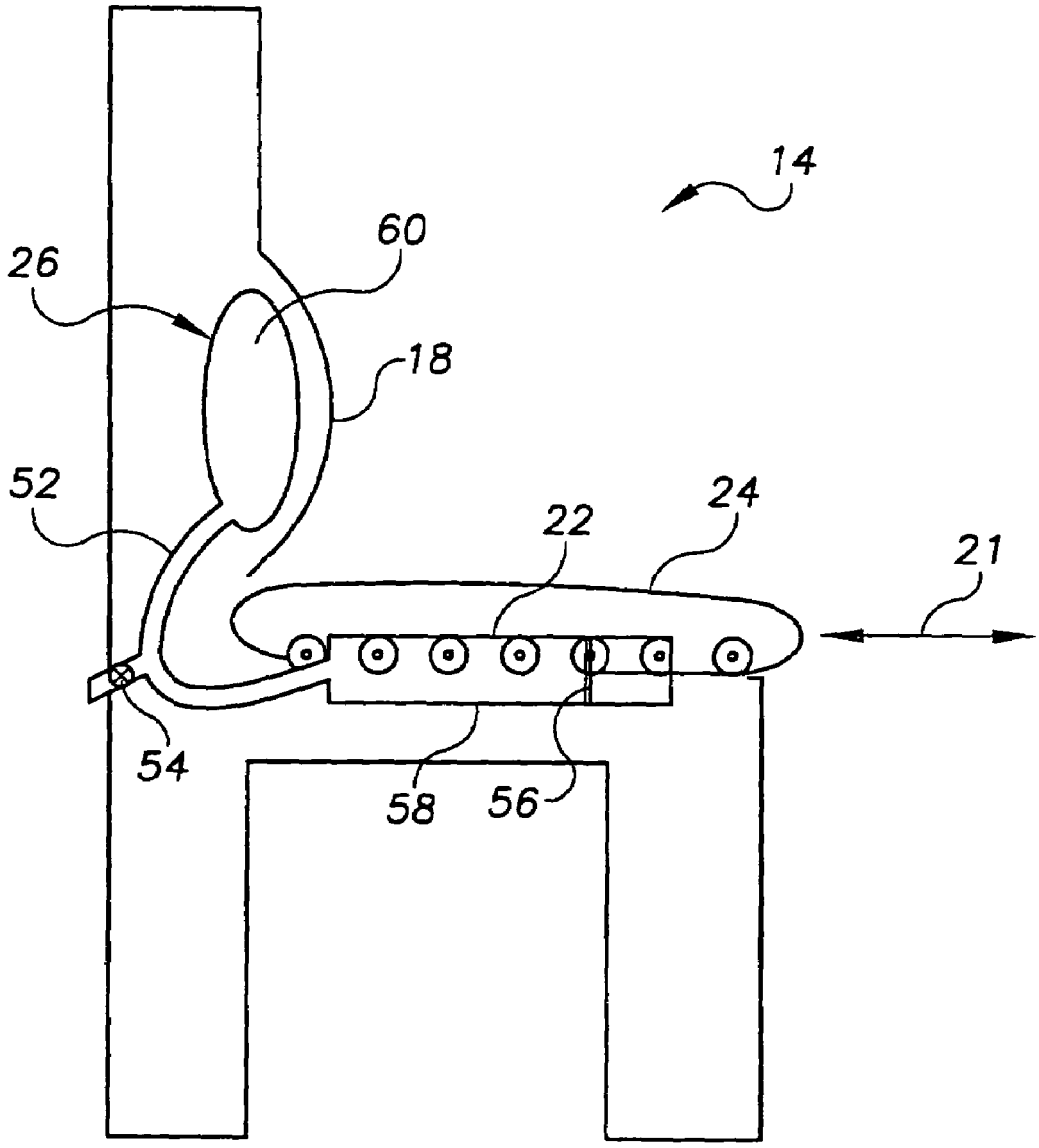
FIG. 3 is a schematic diagram illustrating a side view of a seating system including a fluid-inflatable bladder for increasing and decreasing the force applied to the back engaging surface by the force applying means.

FIG. 3 represents a seating system 14 in which the force applying means 26 further comprises a fluid-inflatable bladder 60, which, by means of a conduit 52, is in communication with a fluid reservoir 58 and a piston 56 in further communication with the seat pan 24. As in other embodiments, the seat pan 24 moves backward and forward along the track assembly 22. The backward movement of the seat pan 24 drives the piston 56 into the fluid reservoir 58, thereby displacing fluid from the fluid reservoir through the conduit 52 into the fluid-inflatable bladder 60. As the fluid-inflatable bladder 60 fills with fluid and expands, the back engaging surface 18 is forced forward, applying pressure to the lumbar region 11 of the spine. Forward movement of the seat pan 24 pulls the piston 56 forward through the fluid reservoir 58, drawing fluid from and thereby deflating the fluid inflatable bladder 60. Alternatively, the inflatable bladder 60 may be deflated by a deflation valve 54 activated by the forward motion of the seat pan 24. Similar to other embodiments, the user may adjust the allowed amount of seat pan 24 movement or lock the seat pan 24 in one place. Thus, the motive force supplied by the moving apparatus 20 is translated into an increasing or decreasing force applied to the back engaging surface 18, thereby cycling the lower back through a substantial range of lordosis and applying changing pressures to the soft tissues.

Figure 4A:
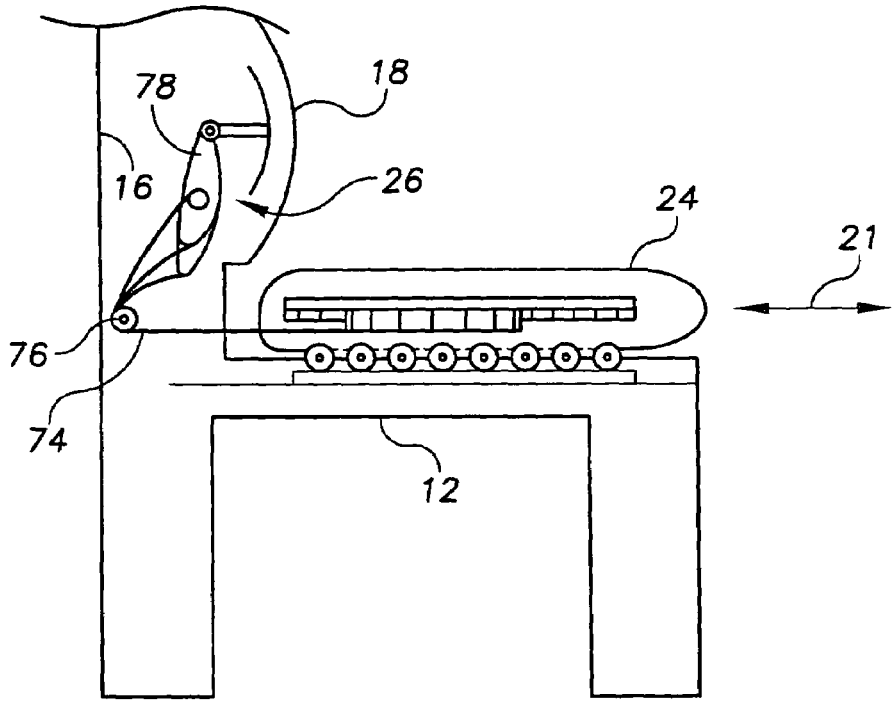
FIG. 4*a* is a schematic diagram illustrating a side view of a seating system including a gear and cable arrangement for increasing and decreasing the force applied to the back engaging surface by the force applying means.
Figure 4B:
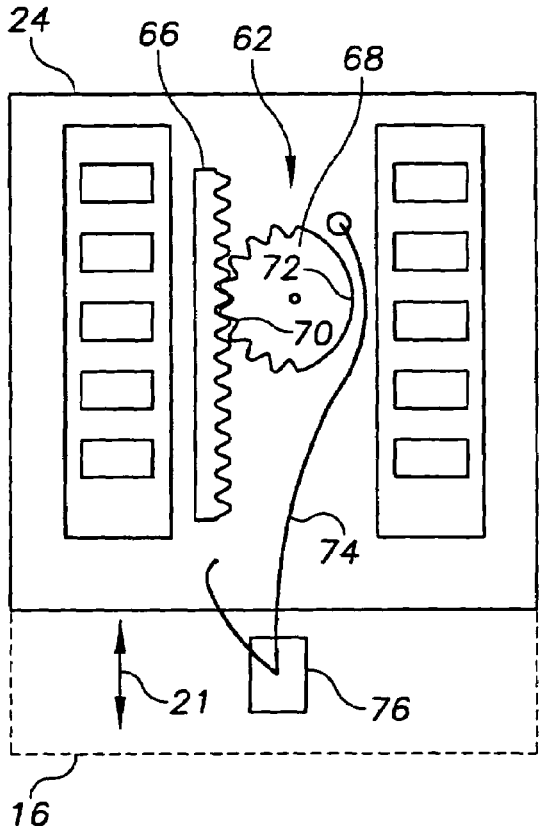
FIG. 4*b* is a schematic diagram illustrating a top view of a seating system including a gear and cable arrangement for increasing and decreasing the force applied to the back engaging surface by the force applying means.

FIGS. 4*a* and 4*b* illustrate side and top views of a seating system in which the force applying means 26 includes a rack and pinion system 62. The rack and pinion system 62 further comprises a rack 66, a pinion (or gear) 68, a pulley 76, a cable 74, and a lever arm 78. The pinion 68 has a meshing side (or surface) 70 and a non-meshing side 72. The rack 66 and pinion 68 are statically affixed to the underside of the seat pan 24 and bottom support 12, respectively, in such a manner that the meshing side 72 of the pinion 68 is received by the rack 66. The cable 74 is attached on a first end to the non-meshing side 72 of the pinion 68. The cable 74 runs from the non-meshing side 72 of the pinion 68 through the pulley 76, which is securely positioned at or proximate to the intersection of the bottom support 12 and the back rest 16, and is attached at its other end to the lower end of the lever arm 78. The lever arm 78 is pivotably mounted within the back rest 16 such that the upper end of the lever arm 78 is in communication with the back engaging surface 18. When the seat pan 24 moves backward (towards the back rest 16), the pinion 68 moves along the rack 66, winding the pinion 68 and pulling the cable 74 forward. As the cable 74 is thusly pulled underneath the seat pan 24, it increases tension through the pulley 76 and pulls the lower end of the lever arm 78 backward. The backward motion of the lower end of the lever arm 78 pushes the upper end of lever arm 78, and hence the back engaging surface 18, forward. The cable connection to the lower end of the lever arm may be adjusted along the height of the lever arm to increase or decrease the correlation between the seat pan 24 motion and the effected motion of the lever arm 78. Thus, the motion of the seat pan 24, causing the lengthening and shortening of the cable 74 through the rack and pinion system 62, effects an increase and/or decrease of the force applied to the back engaging surface 18, thereby cycling the lower back through a substantial range of lordosis and applying changing pressures to the soft tissues.

Figure 5:
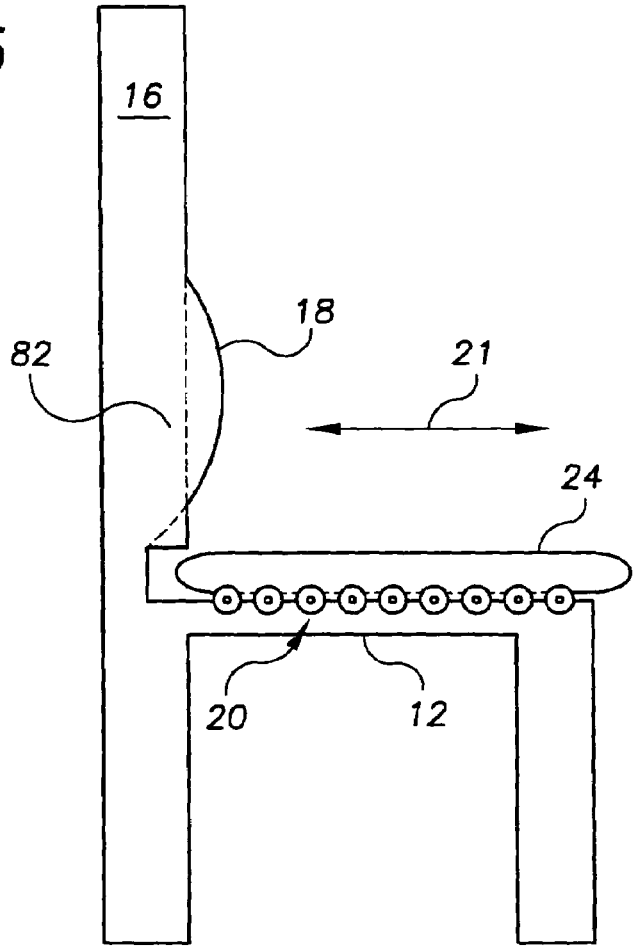
FIG. 5 is a schematic diagram illustrating a side view of an alternative embodiment of a seating system according to the invention.

FIG. 5 illustrates another embodiment of a seating system for providing motion and support to the lumbar region. In this embodiment, a static but adjustable lumbar support 82 including a back engaging surface 18 is disposed between the back rest 16 and the lumbar region 11 of the user. The lumbar support mechanism 82 in this configuration is adjustable to a predetermined comfort level, but preferably made static once that comfort level has been adjusted. Employing any of the moving apparatus 20 configurations described above, the user moves the seat pan 24 backward (in a direction along arrow 21 toward the back rest 16), bringing his or her lumbar region 11 more firmly into contact with the back engaging surface 18. As the seat pan 24 continues moving backward, the pressure applied by the lumbar support mechanism 82 to the lumbar region increases creating soft tissue compression and/or spinal motion as desired by the user. And as the seat pan 24 moves forward, the pressure applied to the lumbar region decreases.

Figure 6:
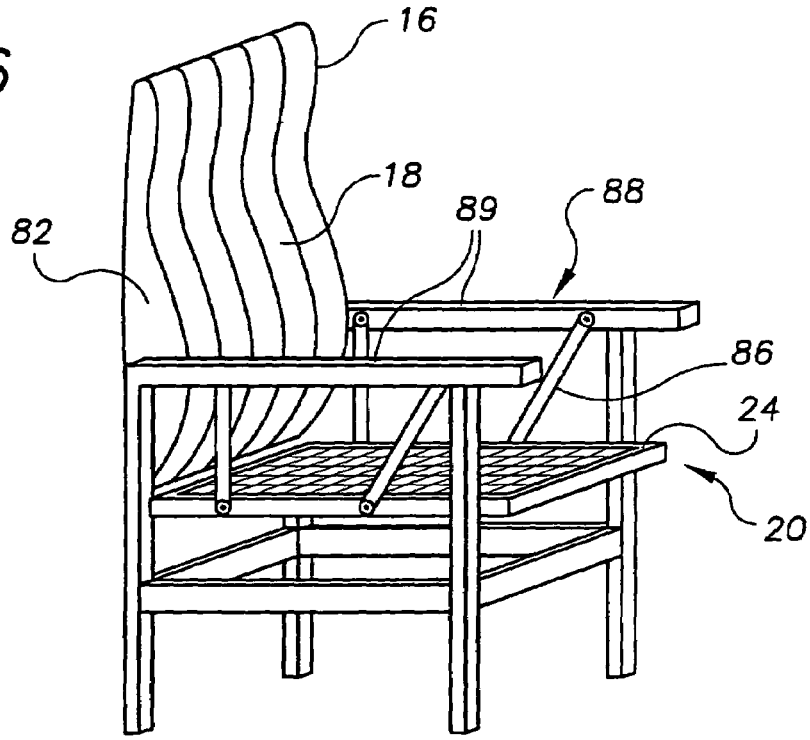
FIG. 6 is a schematic diagram illustrating a seating system including a suspension and swing assembly that supports the horizontal movement of the seat pan.

FIG. 6 represents an embodiment of the invention wherein a lumbar support 82 including a back engaging surface 18 is disposed between the back rest structure 16 and the back of the user. As above, the lumbar support may be adjusted and then made static at a predetermined comfort or support level. In this embodiment, however, the moving apparatus 20 further comprises a seat pan 24 constrained for motion in a horizontal plane as it swings from a swing assembly 86 suspended from a substantially static suspension assembly 88. The suspension assembly 88 may be comprised of the two arm rests 89 of the seating system, or any other means capable of supporting the weight of the seated person. The person may push the seat pan 24 backward toward the back rest 16, bringing his or her lumbar region into contact with the back engaging surface 18 of the lumbar support 82. As the seat pan 24 moves backward, the pressure applied by the lumbar support 82 to the lumbar region of the person increases. Reversing the motion of the seat pan 24 likewise decreases the force applied to the lumbar region of the person. The seat back 22 and arm rests 89 encourage upper body stability, keeping the person's head and eyes still for task performance. Seat pan 24 motion, effected by the person's quadriceps, will shift ischial pressure points.

Figure 7:
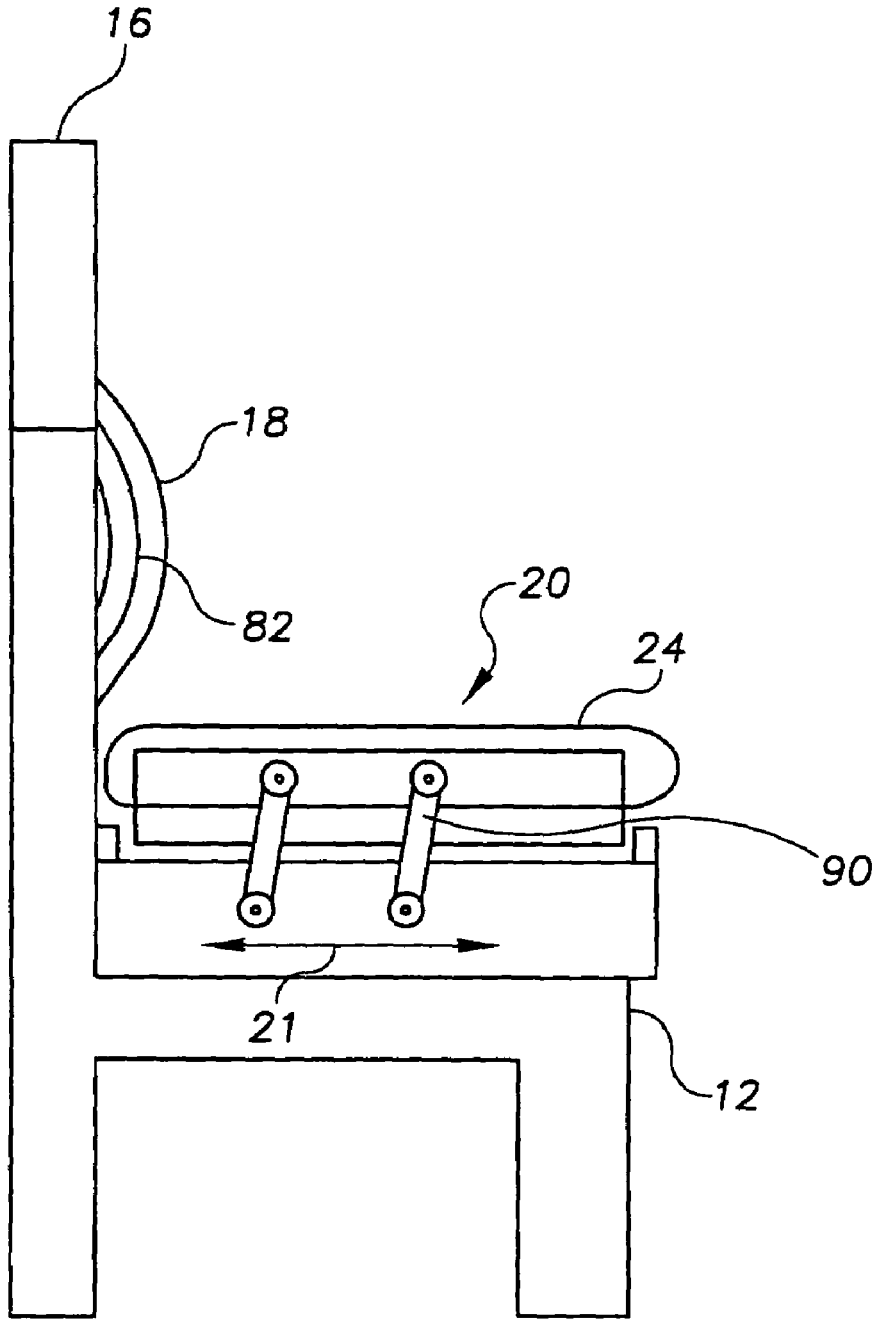
FIG. 7 is a schematic diagram illustrating a seating system including a glider assembly connected to the seat pan.

FIG. 7 represents a slightly different seating system embodiment also employing an adjustable lumbar support 82 set at a predetermined support level. In this embodiment, the moving apparatus 20 further comprises a seat pan 24 supported by a glider assembly 90. The motion of seat pan 24 is constrained in a horizontal plane perpendicular to the back rest 16. The glider assembly 90 allows such seat pan motion without a suspension assembly as described above. Pressure is similarly effected, however, by the motion of the seat pan 24 bringing the user's lumbar region into greater or lesser contact with the back engaging surface 18 of the adjustable lumbar support 82.

Figure 8A:
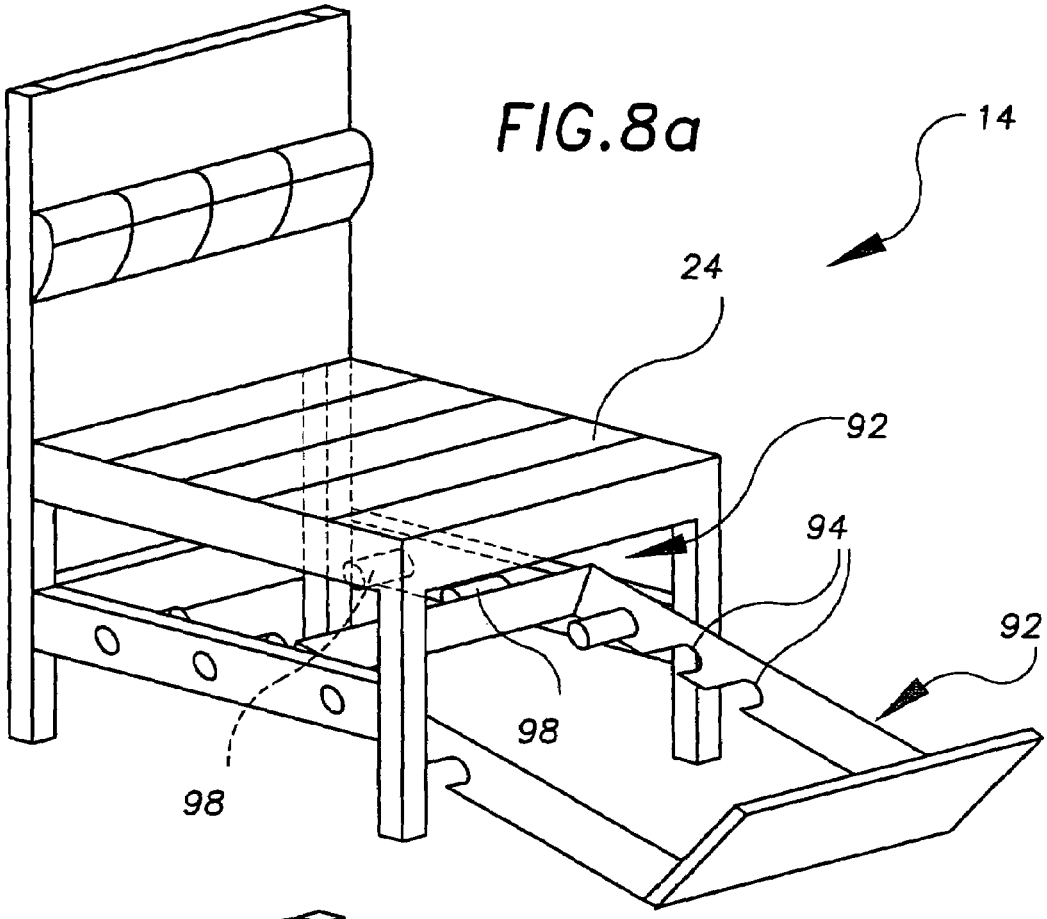
FIG. 8*a* is a schematic diagram illustrating a substantially static foot rest structure configuration.
Figure 8B:
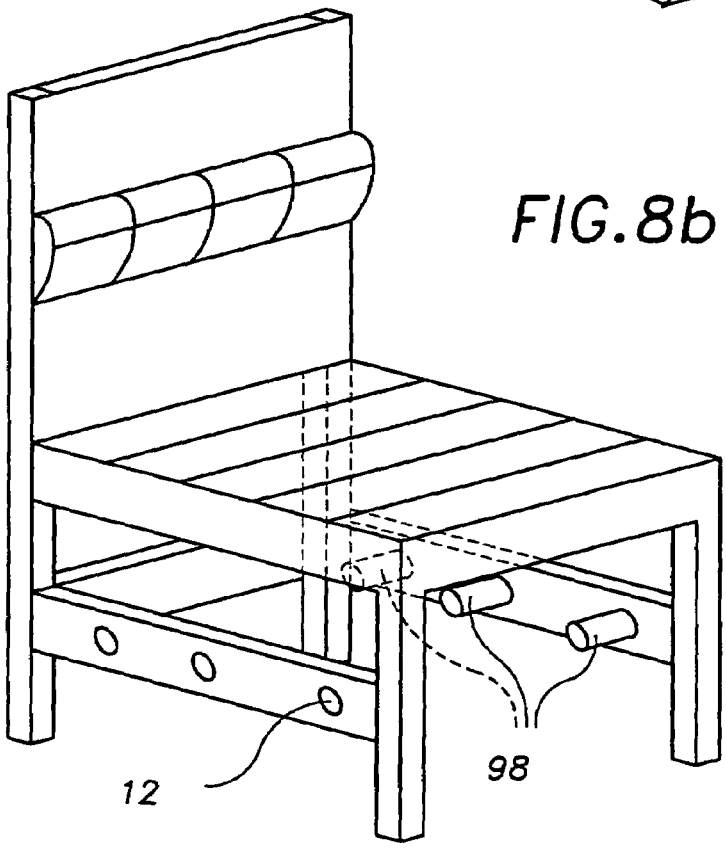
FIG. 8*b* is a schematic diagram illustrating a seating system without the foot rest structure.
Figure 8C:
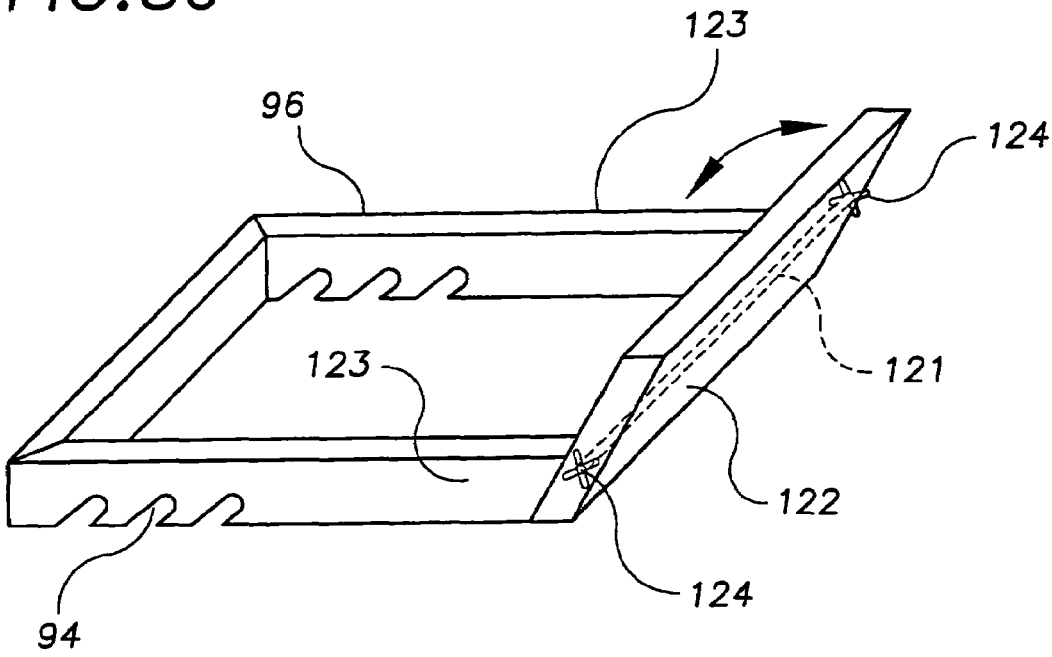
FIG. 8*c* is a schematic diagram illustrating a seating system including a foot rest structure.
Figure 8D:
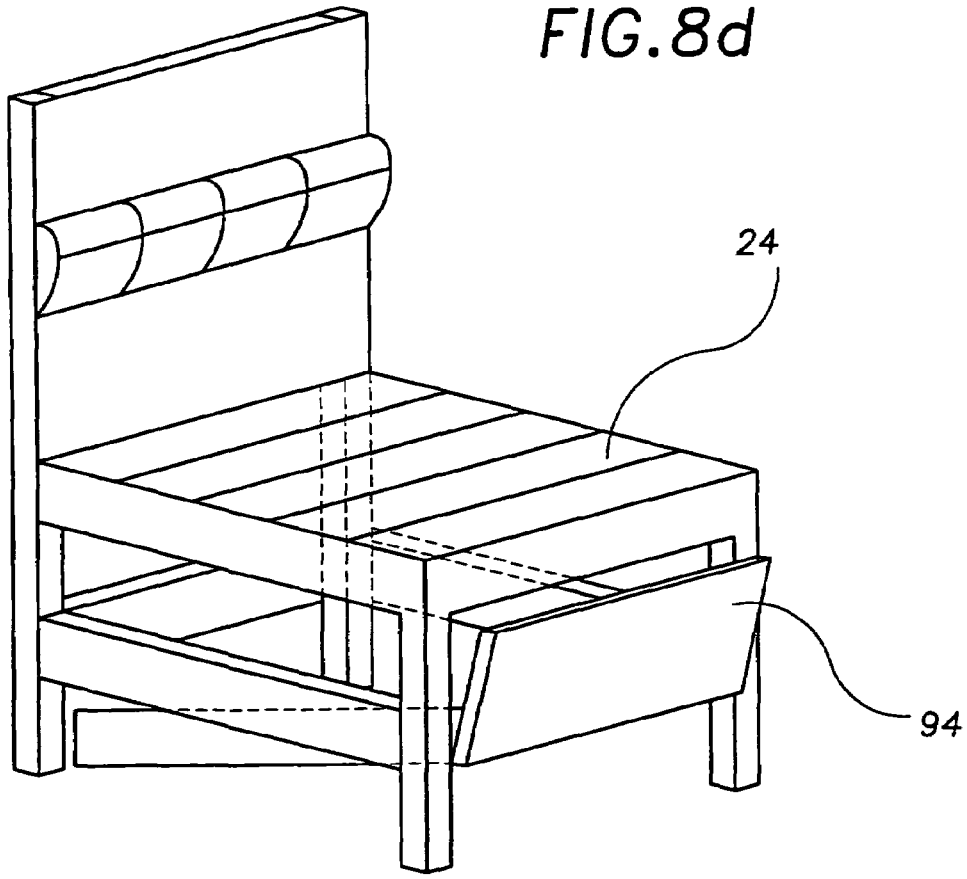
FIG. 8*d* is a schematic diagram illustrating a seating system wherein the foot rest structure is stowed.

Any of the embodiments described above may be configured with a substantially static foot rest 92 which may be deployed from beneath the seat pan 24 of seating system 14, such as shown in FIG. 8*a*. FIG. 8*b* illustrates at least one peg 98 may protrude from bottom support 12 adapted to receive a notch 94 in the foot rest 92. FIGS. 8*a* and 8*c* illustrate at least one notch 94 in the foot rest 92 shaped to fit and accept the at least one peg 98. FIG. 8*a* further illustrates that the foot rest 92 may be adjusted by means of the notches 94 to accommodate the height or length of the lower extremities of the person sitting in the seating system. The foot rest 92 may be secured underneath the seat pan 24 when not in use (see FIG. 8*d*). The angle of the footrest plate should be adjustable to encourage use of the posterior calf muscles thereby improving deep vein circulation and preventing thrombosis. Referring to FIG. 8*c*, this may be accomplished simply by the use of an axle 121 that passes through both the footplate 122 and sideboards 123, and one or more wing nuts 124 to lock the footplate 122 in a chosen position. By adjusting the footplate toward a more vertical position, the contact will be more through the ball of the foot and the person will create some of the backward push by contracting the posterior calf muscles (gastrocnemius) and creating ankle plantar flexion. This muscle recruitment is desirable as it may improve clearance of venous blood and reduce the risk for deep vein thrombosis and secondary pulmonary embolism.

Figure 8E:
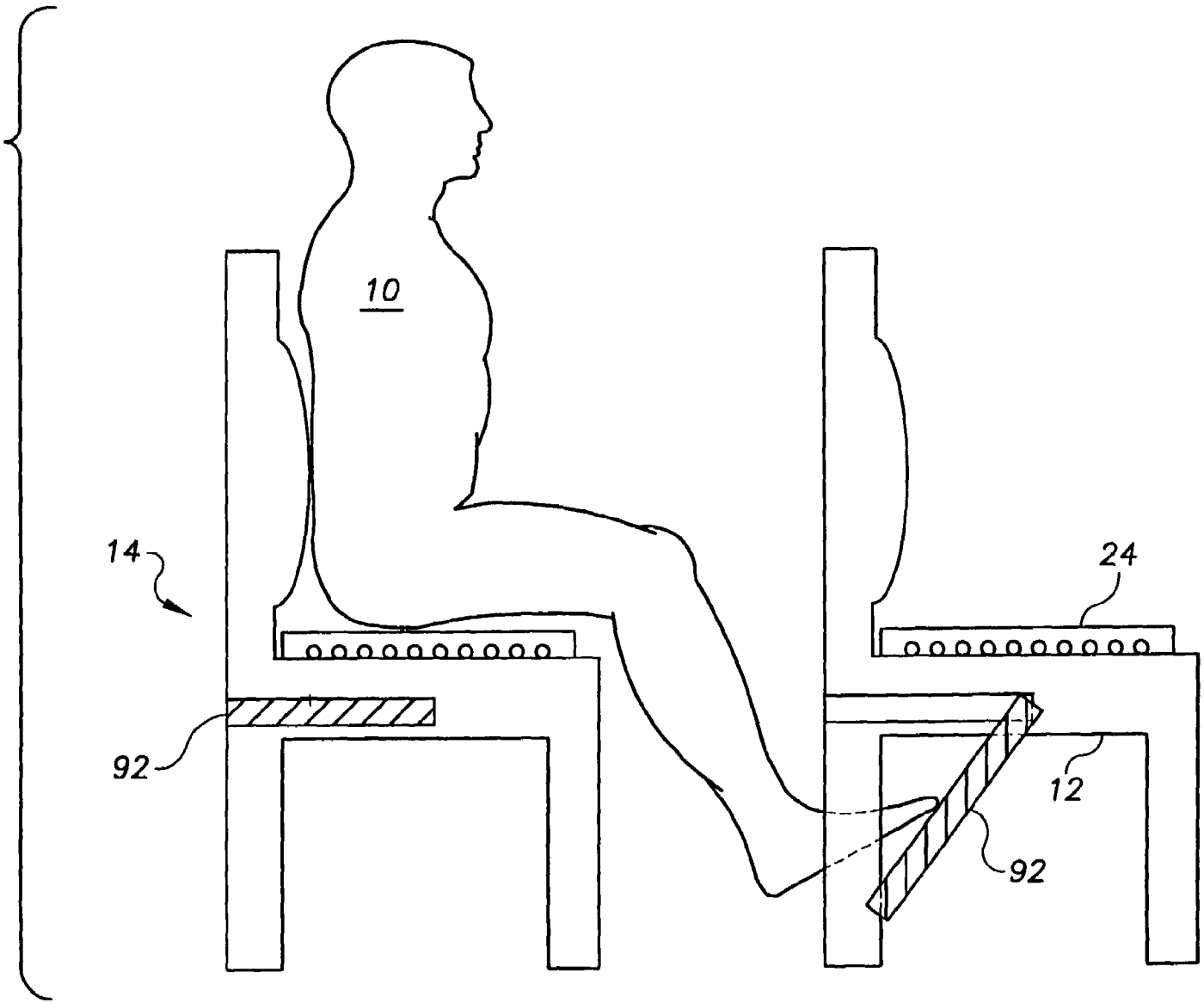
FIG. 8*e* is a schematic diagram of an arrangement of serially oriented seating systems employing a foot rest embedded within the bottom support of the seating system.

In another embodiment illustrated by FIG. 8*e*, the foot rest 92 may be deployed from beneath the seat pan 24 of a similar, serially oriented seating system 14. This configuration finds particular utility in mass transportation systems such as airplanes and buses. The static foot rest 24 may be stowed in an upward position when not in use, as shown in the occupied seating system 14. When needed, the foot rest 92 may swing down and oriented to meet the forefoot of a person 10. This will encourage the use of the person's calf muscles to improve deep vein circulation.

Figure 9:
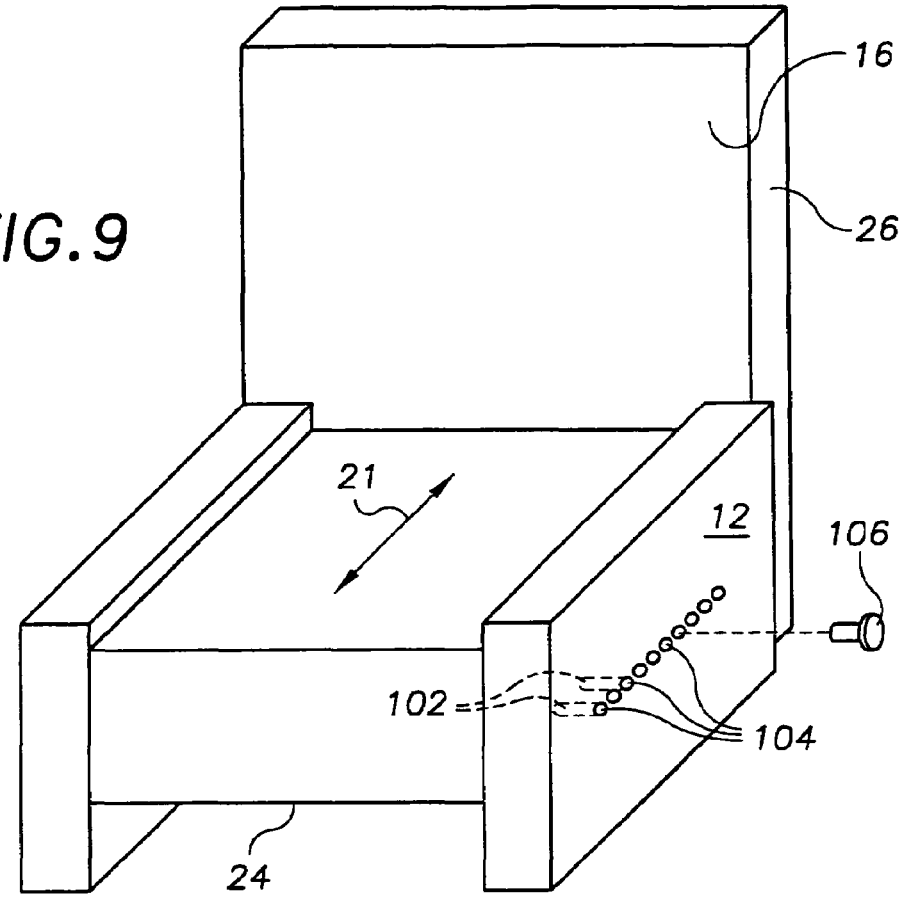
FIG. 9 is a schematic diagram illustrating a locking mechanism.

FIG. 9 illustrates an embodiment of a locking mechanism for the moving apparatus 20, in which the seat pan 24 remains constrained to motion along the direction perpendicular to the back rest 16. Employing any of the moving apparatus 20 configurations described above, a static force may be supplied to the force applying means 26 by locking the seat pan 24 in one position. The force applying means 26 resultingly applies a static pressure to the lumbar region of the user's spine. The level of static pressure is determined by the position at which the seat pan 24 is locked with respect to the back rest 16. The locking mechanism is further comprised of one or more holes 102 along the side of the seat pan 24 which align with one or more holes 104 along the side frame of the bottom support 12. At least one peg 106 may be inserted through one or more of the holes 104 and into a selected hole 102, thereby locking the seat pan 24 into a desired position. Other configurations of locking mechanisms should be obvious to one skilled in the art and are clearly within the scope of the present invention.

Figure 10A:
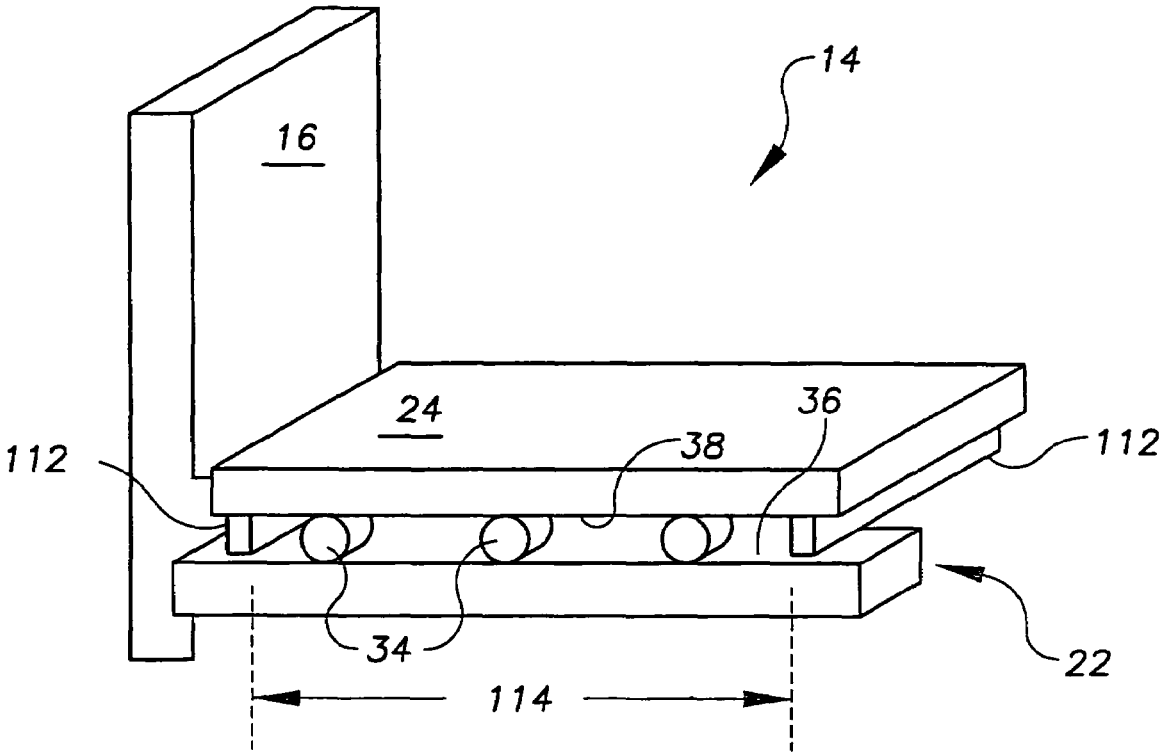
FIG. 10*a* is a schematic diagram illustrating a means for restricting the seat pan movement.

FIG. 10*a* illustrates one embodiment of a means for limiting the forward and backward movement of the seat pan 24. The limiting means further comprises at least one stopping panel 112 perpendicular to the track assembly 22, to restrict movement and/or create a set range of allowed forward and backward motion of the seat pan 24. In a preferred embodiment, stopping panels 112 are located both in front of, as well as behind, roller bearings 34 along the track assembly 22. In this embodiment, the roller track 36 is a component of the bottom support 12 while the guide track 38 is a component of the seat pan 24. The front and back stopping panels 112 contact the front and back roller bearings 34, respectively, when the seat pan 24 has moved sufficiently forward or backward, preventing further seat pan 24 movement. The distance 114 between the front and back stopping panels 112 may be adjusted to restrict the seat pan 24 range of motion.

Figure 10B:
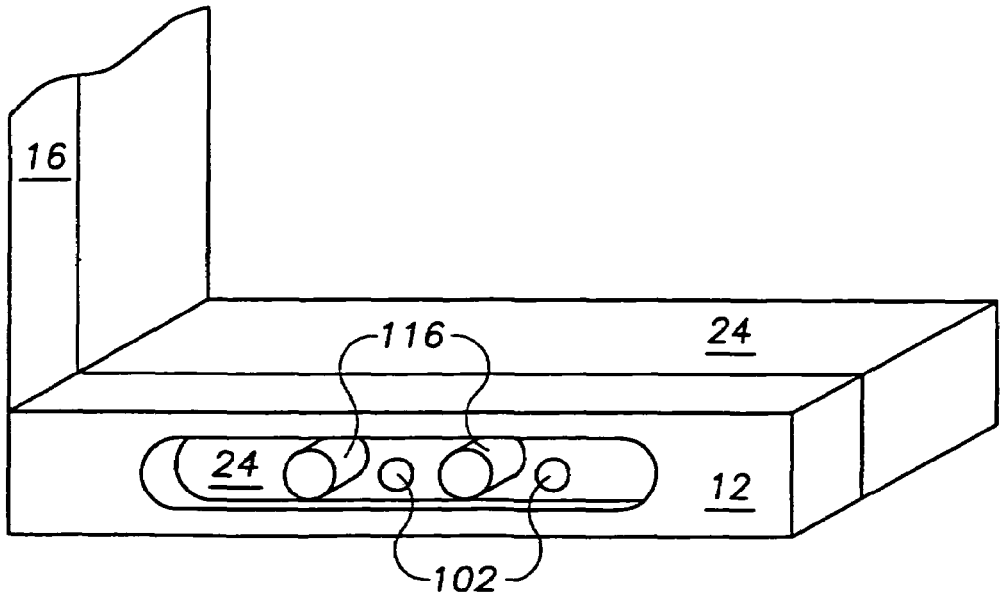
FIG. 10*b* is a schematic diagram illustrating an alternative means for restricting the seat pan movement.

Alternatively, as shown in FIG. 10*b*, one or more dowels 116 may be employed in limiting the seat pan 24 movement beyond a predetermined position in either a forward or a backward direction. The dowels 116 may be inserted into holes 102 along the side of the seat pan 24 through an opening in the bottom support 12. Depending upon which hole 102 in the side of seat pan 24 a dowel 116 has been inserted, the seat pan 24 may be allowed a greater or lesser range of motion, as the dowel 116 comes into contact with the edge of the bottom support opening and prevent further seat pan motion.

Figure 11:
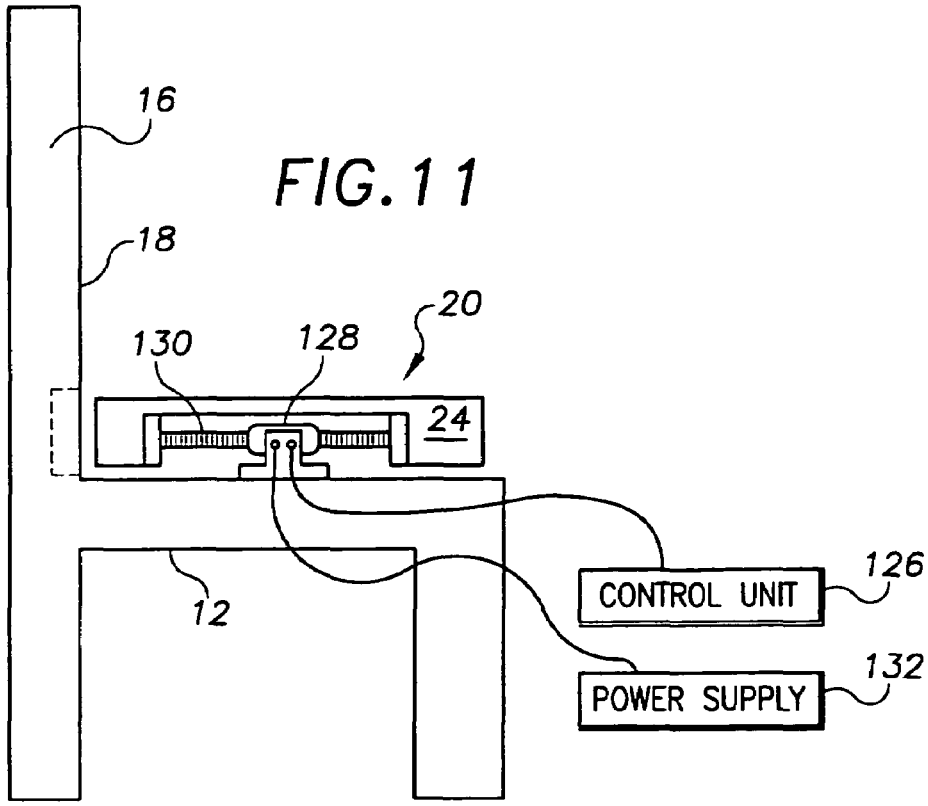
FIG. 11 is a schematic diagram illustrating an embodiment according to the invention including a reversible electric motor and gear mechanism.

In yet another embodiment, depicted in FIG. 11, the moving apparatus 20 may be electronically powered rather than powered by the user's lower extremities. In this embodiment, a control unit 126 activates a reversible electric motor 128 that drives a gear mechanism 130 to move the movable seat pan 24 in the desired direction toward or away from the back engaging surface 18. A power supply 132 that may comprise a battery or a line supply provides the power required by the reversible electric motor 128. In this embodiment, the motion of the seat pan 24 is still responsible for supplying the motive force to the force applying means 26 (not shown) for translation to a back engaging force.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A seating system for providing spinal motion and support, comprising:

a substantially static structure adapted to support a back of a user;

a moving apparatus including a movable seat pan adapted to support buttocks and thighs of the user, and the movable seat pan movable along a plane, perpendicular to the substantially static structure, to convey a motive force to a force applying means, the moving apparatus including a spring mechanism to preload the movable seat pan to create resistance to movement away from the static structure;

the force applying means including a back engaging surface extendible from the static structure and adapted to engage the back of the user, the force applying means adapted to translate the motive force conveyed by the moving apparatus into a movement of the back engaging surface in a direction substantially parallel to movement of the movable seat pan with respect to the static structure, wherein the movement of the back engaging surface correlates to and is driven by a movement of the moveable seat pan and wherein the back engaging surface moves in a direction substantially opposite to a direction of the movement of the moveable seat pan, thereby increasing and decreasing the force applied to the back engaging surface to cycle through a range of spinal motion and support; and a locking apparatus for locking a position of the moveable seat pan.

2. The seating system of claim 1, further comprising a static foot rest structure situated beneath the movable seat pan.

3. The seating system of claim 2, wherein the foot rest structure includes a footrest plate adjustable over a range of angles and adapted to encourage posterior calf muscle use.

4. The seating system of claim 2, wherein the foot rest structure includes a notch adapted to accept a peg on the seating system to attach the foot rest structure to the seating system, the notch also adapted to disengage from the peg to remove the foot rest structure from the seating system.

5. The seating system of claim 2, wherein the foot rest structure is configured to recede to a position beneath the moving apparatus.

6. The seating system of claim 1, wherein the moving apparatus further comprises a track assembly slidably connected to the movable seat pan, wherein the movable seat pan rolls along the track assembly, thereby increasing and decreasing the motive force conveyed to the force applying means.

* * * * *